United States Patent [19]

El Ibiary

[11] 4,456,434

[45] Jun. 26, 1984

[54] POWER TRANSMISSION

[75] Inventor: Yehia El Ibiary, Troy, Mich.

[73] Assignee: Vickers, Incorporated, Troy, Mich.

[21] Appl. No.: 353,529

[22] Filed: Mar. 1, 1982

[51] Int. Cl.[3] ..... F04B 1/26

[52] U.S. Cl. ..... 417/218; 60/389; 137/625.65; 137/625.69

[58] Field of Search ..... 417/218, 222; 60/443, 60/445, 452, 389; 137/625.65, 625.69

[56] References Cited

U.S. PATENT DOCUMENTS

| | | | |
|---|---|---|---|
| 2,916,019 | 12/1959 | Murphy | 137/625.65 |
| 3,307,824 | 3/1967 | Weisheit | 137/487.5 X |
| 3,758,235 | 9/1973 | Breeden | 417/222 |
| 3,784,327 | 1/1974 | Lonnemo | 417/222 |
| 3,788,775 | 1/1974 | Leutner et al. | 417/222 |
| 3,875,849 | 4/1975 | Patel | 137/625.64 X |
| 4,103,489 | 8/1978 | Fletcher et al. | 60/452 X |
| 4,238,112 | 12/1980 | Derozier | 137/625.65 X |
| 4,310,143 | 1/1982 | Determan | 251/137 X |

FOREIGN PATENT DOCUMENTS

| | | | |
|---|---|---|---|
| 2305825 | 8/1974 | Fed. Rep. of Germany | 417/222 |

*Primary Examiner*—Edward K. Look

*Attorney, Agent, or Firm*—Barnes, Kisselle, Raisch, Choate, Whittemore & Hulbert

[57] ABSTRACT

A variable displacement pump control system comprising a variable displacement pump having a movable element for controlling pump displacement, a hydraulic motor for moving the movable element, and a transducer for producing an electric signal corresponding to the actual position of the movable element. A comparator compares the electrical signal from the transducer and an electrical signal corresponding to the desired displacement of the pump and produces an error signal. A control operates in response to the error signal to meter fluid flow from the pump output to the hydraulic motor. The control comprises a relief valve, a compensator valve and a servo valve. The servo valve is preferably a single-stage valve that includes damping orifices to provide stability.

14 Claims, 4 Drawing Figures

POWER TRANSMISSION

This invention relates to variable displacement pumps and particularly to variable displacement pump control systems.

BACKGROUND AND SUMMARY OF THE INVENTION

In the use of variable displacement hydraulic pumps, it is desirable to vary the displacement of pump in response to a control in order to obtain maximum efficiency. It has heretofore been suggested that an electro hydraulic control system be provided. Typical such systems are shown in U.S. Pat. No. 4,139,987 wherein the system senses the load and varies the displacement.

Most prior art servo controls for controlling pump displacement through yoke positioning use a two-stage servo valve with a flapper nozzle arrangement as typified in U.S. Pat. No. 4,139,987. Such arrangements are costly to manufacture. Other two-stage servo valves used in this type application use a two spool arrangement but the small pilot spool stage has a low tolerance to contamination due to the small size.

Since single-stage servo valves are inherently more contamination tolerant and less costly than two-stage servo valves, they have been considered for use with the yoke-positioning controls of hydraulic pumps. However, such single-stage servo valves and pump combinations up to now have been limited to these applications which require relatively low flow rates and low speed response times, for example 500 milliseconds. In such applications requiring higher flow rates and faster response times, for example 70–100 milliseconds, single-stage servo valves become unstable due to the large flow forces action on the spool of the single-stage valve. For this reason the two-stage servo valve and pump combination predominate where higher flow rates and faster response times are required.

Among the objects of the present invention are to provide an electro hydraulic variable displacement pump control system which functions in response to actual movement of a movable element in the pump which controls displacement of the pump and functions to quickly and efficiently control the pump displacement.

In accordance with the invention, the variable displacement pump control system comprises a variable displacement pump having a movable element for controlling pump displacement, a hydraulic motor for moving the movable element, and a control module comprising a transducer for producing an electric signal corresponding to the actual position of the movable element, means for producing an electrical signal corresponding to the desired pump displacement, means for comparing the electrical signal from the transducer and the electrical signal corresponding to the desired displacement of the pump and producing an error signal, and a control operable in response to the error signal to meter fluid flow from the pump output to the hydraulic motor. The control comprises a relief valve, a compensator valve and a servo valve. The servo valve is preferably a single-stage valve that includes damping orifices to provide stability.

DESCRIPTION

Figure 1:
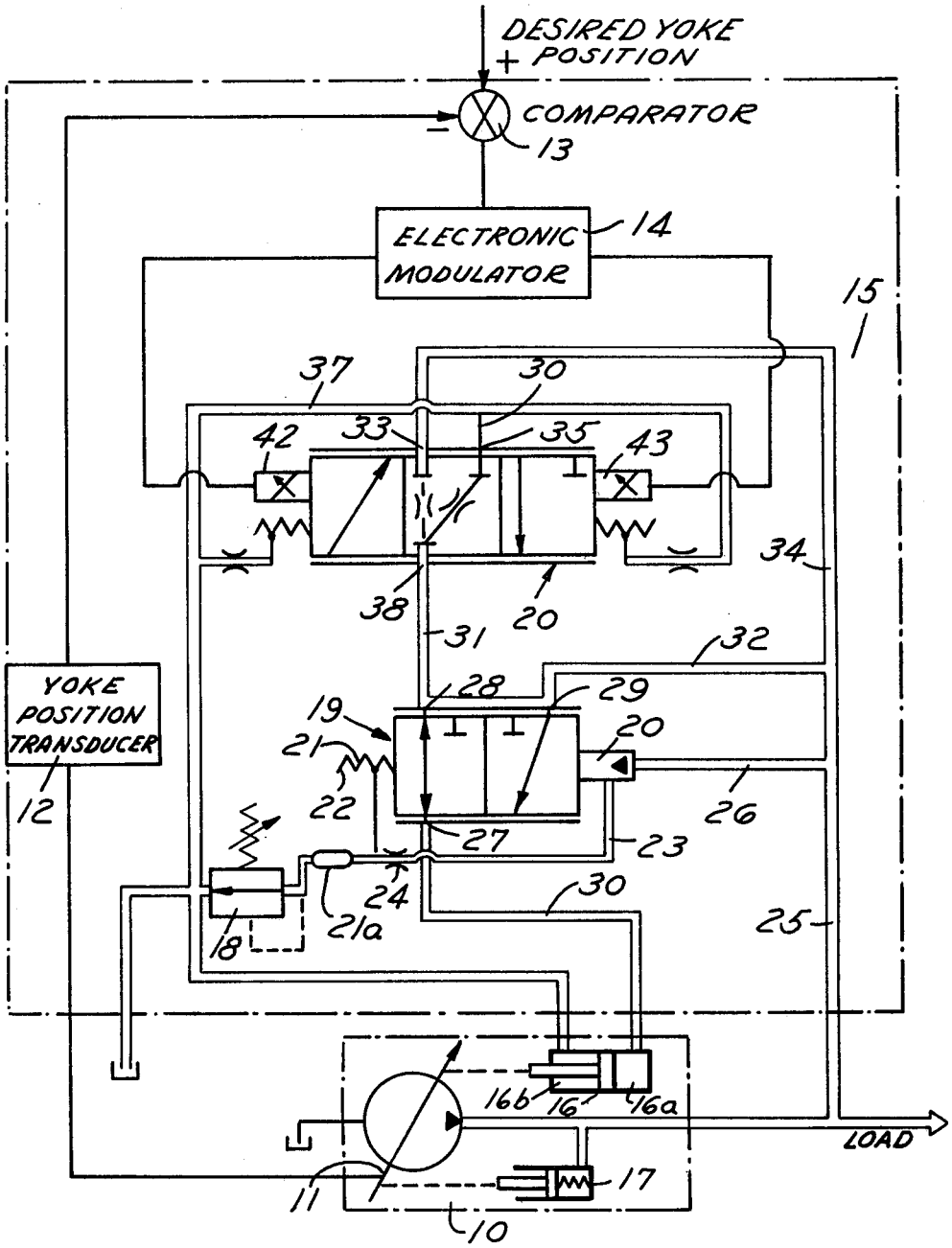
FIG. 1 is a schematic of the variable displacement control system embodying the invention.

Referring to FIG. 1, the variable displacement control system embodying the invention comprises a variable displacement pump 10 having a movable element 11 for controlling pump displacement, and a control module 15 comprising a position transducer 12 operable to produce an electrical signal corresponding to the actual position of the movable element, a comparator 13 for comparing the electrical signal from the transducer 12 and a command electrical signal corresponding to the desired position of the movable element and producing an error signal, and an electronic modulator 14 for modulating the error signal.

The pump 10 is preferably of the yoke controlled type wherein the element 11 is a yoke movable by a yoke actuating cylinder 16 against the action of a yoke return cylinder 17. The yoke return cylinder 17 urges the yoke to a position corresponding to full displacement of the pump.

The control module 15 is operable below a predetermined output pressure of the pump 10. The control module 15 operates by metering fluid flow from the pump 10 output to or from the yoke actuator cylinder 16 in the pump 10 in response to an error signal. The error signal is generated by the comparator element 13 which sums the position signal from the yoke position transducer 12 and a command signal representing the desired yoke position, i.e. subtracts the signal representing the actual yoke position from the input signal representing the desired yoke position. The error signal is transmitted to the electronic modulator 14 which converts the error signal to a pulse train signal having a pulse width proportional to the magnitude of the error signal.

The control module 15 further comprises a control in the form of a maximum pressure relief element 18, a compensator element 19, and a servo element 20.

The relief element 18 is adjustable for setting a preselected maximum system pressure and opens the compensator element 19 to a reservoir tank upon sensing the preselected maximum pressure.

The compensator element 19 is a three-way valve having a compensator spool positioned between a pilot chamber **20*a* at one end of the compensator element, and a spring chamber 21 at the opposite end of the compensator element. A spring member 22 acting on the spool member is positioned in the spring chamber. The spring chamber 21 serves as an accumulator volume 21*a* and has the spring member 22 acting on the spool member positioned therein. A passage 23 in the spool member connects the pilot chamber with the spring chamber and is formed with a restriction or orifice 24. The pilot chamber 20 is connected to the output of the pump by lines 25, 26 for applying pump output pressure against the spool member. The spring chamber 21 is connected to the input of the relief element 18**.

The spring rate of the spring member 22 is selected to oppose movement of the compensator spool by the pump output pressure until the output pressure exceeds the pressure setting of the relief element 18. The combination of the orifice 24 and the accumulator volume of the spring chamber 21 serve to dampen momentary excessive rates of pressure rise that may occur in the pump output and prevent premature actuation of the relief element. With the foregoing construction of the compensator element 19, the compensator spool remains stationary up to the pressure setting of the relief valve element 18.

The compensator element 19 further includes first, second and third ports 27, 28, 29. The first port 27 connects the compensator element 19 to the head end 16*a* of the yoke actuator cylinder 16 through line 30; the second port 28 connects the compensator element 19 to the service port 38 of the servo element 20 through line 31; and the third port 29 connects the compensator element 19 to the output of the pump 10 through line 32. With the spool member in its spring-held position, the first and second ports 27, 28 are in communication with each other and communication is established between service port 38 of servo element 20 and the head end 16*a* of the actuator cylinder 16. With the spool member shifted by pressure at the maximum pressure setting from the pump output, communication between the servo output port and the head end 16*a* of the actuator cylinder 16 is interrupted and communication between the third port 29 and the head end 16*a* of the actuator cylinder is established.

Figure 2:
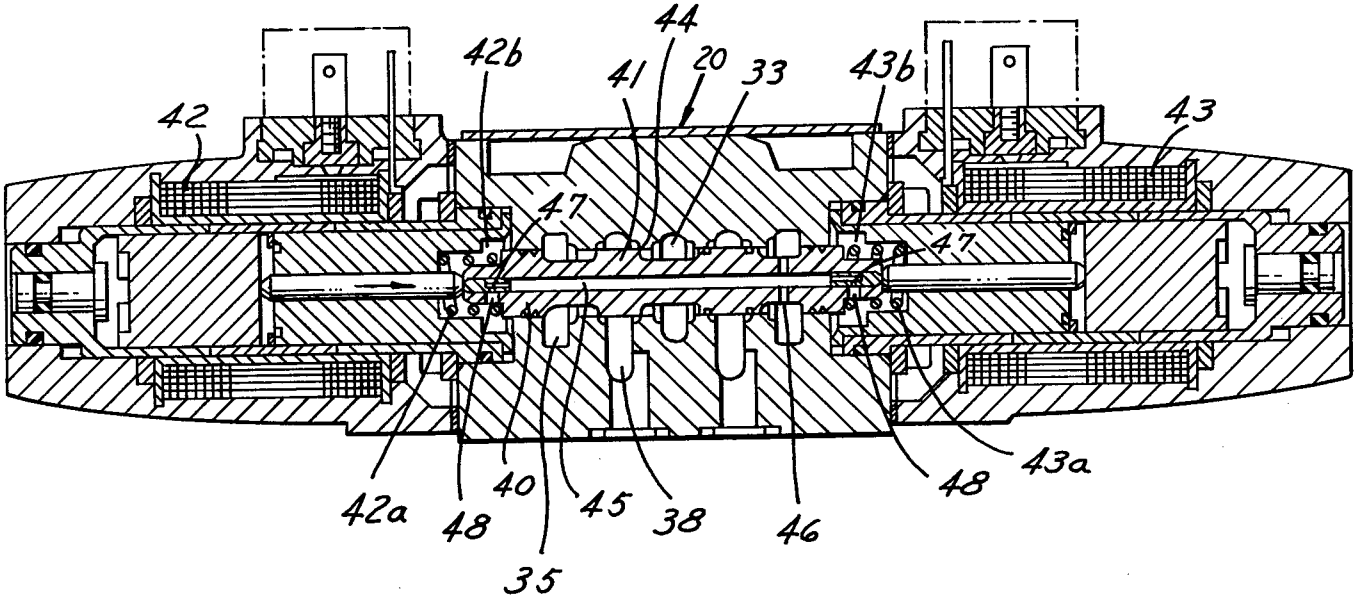
FIG. 2 is a longitudinal sectional view of a solenoid controlled servo element used in the system.

The servo element 20 serves as a three-way valve having a pressure port 33 connected to the pump output through lines 25, 34, a tank port 35 connected to the reservoir tank by lines 36, 37, and as previously mentioned, a service port 38 connected to the head end 16*a* of the actuator cylinder 16 through the second port 28 of the compensator element 19. Referring to FIG. 2 the servo element also includes a servo spool 40 having a service port land 41 which serves to cut off fluid flow between the service port 38 and both pressure port 33 and the tank port 35 depending on the position of the servo spool 40. The servo spool 40 is positioned between a pair of proportional solenoids 42, 43 and also between a pair of opposed servo spring members 42*a*, 43*a* positioned in spring chambers 42*b*, 43*b*. The spring members act to center the servo spool in a neutral position in the absence of energization of either of the solenoids. In the neutral position of the servo spool 40, the service land 41 blocks flow from either the pressure or tank ports to or from the service port 38. However, the service land 41 is formed with an underlap 44, i.e. the width of the land is slightly less than the opening of the service port, and in the neutral position the underlap 44 with respect to the service port forms a restricted passage or orifice between the service port 38 and the pressure and tank ports 33, 35. In the neutral position these orifices serve to vent the head end 16*a* of the actuator cylinder 16 to the reservoir tank thereby insuring positioning of the yoke to its full stroke position.

Figure 3:
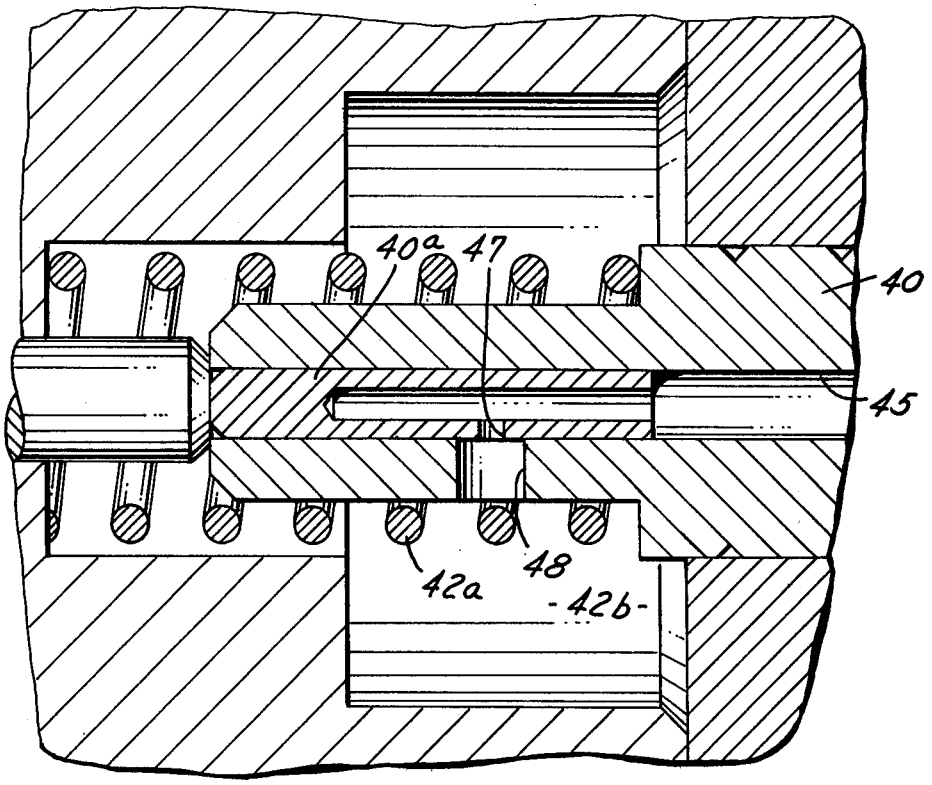
FIG. 3 is a fragmentary sectional view on an enlarged scale of the servo element shown in FIG. 2.

The servo spool 40 is formed with an axial passage 45 which is intersected by a first radial passage 46 which is at all times in communication with the tank port. The axial passage 45 connects the opposed spring chambers with the tank port through a pair of restrictions or orifices 47 formed at each end of the spool 40 in the inserts 40*a* and a pair of second radial passages 48 each of which is in communication with each spring chamber 42*b*, 43*b* in the neutral position of the servo spool. As the servo spool 40 shifts in either direction, the spool moves the fluid in the spring chamber toward which the spool is moving through the orifice 47, the axial passage 45 of the spool 40 and the orifice 47 in the far side. These orifices 47 restrict the flow from one spring chamber to the other to dampen the movement of the servo spool through the restricted displacement of fluid from one of the other of the spring chambers 42*b*, 43*b* thereby improving the response of the servo spool 40 to the energization of one or the other of the solenoids. (FIG. 3)

As previously mentioned, the electronic modulator 13 generates a pulse train signal having a pulse width proportional to the magnitude of the error signal. The electronic modulator 13 directs the generated signal to one of the other of the solenoids 42, 43 of the servo element depending on the sense of the error signal thereby energizing the appropriate solenoid, the width of the generated signal determining the magnitude of movement of the servo spool 40. Movement of the servo spool 40 serves to meter fluid flow to or from the head end 16*a* of the yoke actuator cylinder 16 through the compensator element 19. Movement of the servo spool 40 to the left, as shown in FIG. 1, directs pump output fluid flow to the cylinder 16 to destroke the yoke 11, i.e. reduce pump displacement, and movement to the right directs fluid flow from the head end 16*a* of cylinder 16 to the tank reservoir thereby allowing the yoke return cylinder 17 of the pump to onstroke the yoke 11 to increase pump displacement. In the event of the attainment of maximum pressure the compensator element 19 is actuated and it disconnects or overrides the servo element 20 from control of the pump yoke 11.

Figure 4:
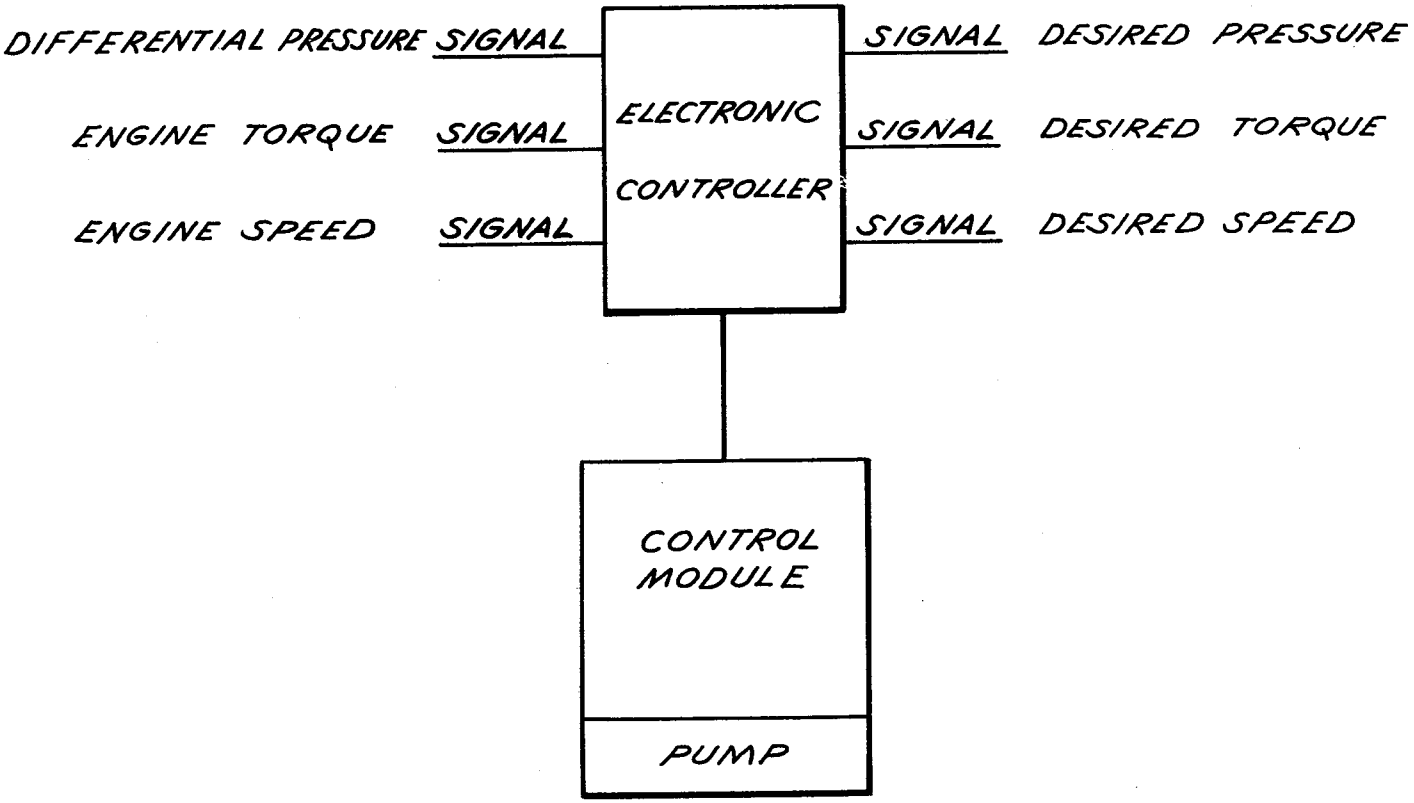
FIG. 4 is a block diagram showing the manner in which the electronic controller can be made to control pump displacement in response to differential pressure, engine torque or engine speed.

The manner in which the system can be utilized for controlling pressure, torque or speed is shown in FIG. 4. The pressure, torque, or speed is sensed using conventional transducers, not shown, and the signal generated by the transducer is fed to the electronic controller and compared with the desired pressure, torque, or speed signal and the difference between the sensed and desired signal generate another signal which is fed to the control module for on-stroking or de-stroking the pump.

I claim:

1. A variable displacement pump control system comprising a variable displacement pump having a movable element for controlling pump displacement, a hydraulic motor for moving said movable element, a control module comprising a transducer for producing an electric signal corresponding to the actual position of the movable element, means for producing an electrical signal corresponding to the desired pump displacement, means for comparing the electrical signal from the transducer and the electrical signal corresponding to the desired displacement and producing an error signal, and means operable in response to said error signal to meter fluid flow from the pump output to the hydraulic motor, said last mentioned means comprising an electrically operated valve, said control module includes an electronic modulator for converting the error signal to a pulse train signal having a pulse width proportional to the magnitude of the error signal, said last mentioned means comprising an electro hydraulic three-way flow control valve, said control valve comprising a solenoid operated servo valve, said valve comprising a body having a pressure port connected to the pump output, a tank port connected to the reservoir, a service port connected to the hydraulic motor, a spool having a service port portion which serves to cut off fluid flow between the service port of the valve and the pressure port or the tank port depending on the position of the spool, said spool including a service land which controls the flow from pressure port to service port and from the service port to tank port, the width of the land being slightly less than the opening of the service port such that in the neutral position, restricted orifices are provided between the service port and the pressure and tank ports thereby venting the hydraulic motor to tank to insure the positioning of the movable element of the pump at its full stroke position, said spool being formed with an axial passage intersected by a radial passage that is at all times in communication with the tank port, said axial passage connecting opposed ends of the spool with the tank port through a restriction formed therein, said spool having a pair of radial passages, each of which is in communication with each end of the spool at all times but upon movement of the spool in either direction fluid flow from one fluid chamber to the other is restricted by an orifice thereby dampening the movement of the spool and improving the response to energization of one or the other of the solenoids.

2. The variable displacement pump control system set forth in claim 1 including a compensator valve operable to dampen momentary excessive rates of pressure that may occur in the pump output.

3. The variable displacement pump control system set forth in claim 2 wherein said compensator valve comprises a three-way valve having a compensator valve body, a spool operable in said body and having a pilot chamber at one end and a spring chamber at the other end, a spring member in the spring chamber, said spring chamber serving as an accumula or volume, said spool of said compensator valve having a passage connecting the pilot chamber with the spring chamber and formed with a restriction, said pilot chamber being connected to the output of the pump for applying pump output pressure against the spool of the compensator valve, said spring chamber being connected to the input of the relief element.

4. The variable displacement pump control system set forth in claim 3 wherein said compensator valve includes first, second and third ports, the first port being connected to the hydraulic motor of the pump, the second port being connected to the service port of the servo valve, and the third port being connected to the output of the pump, such that when the spool of the compensator valve is in its normal position under the action of the spring member, the first and second ports are in communication with each other and communication is established between the servo valve service port and the hydraulic motor and when the spool of the compensator valve is shifted by pressure at maximum pressure setting, communication between the servo output port and the hydraulic motor is interrupted and communication between the pump output and the hydraulic pump is established.

5. The variable displacement pump control system set forth in claim 4 including a pressure relief valve operable upon a preselected system pressure.

6. A pump control system for a variable displacement pump having a movable element for controlling pump displacement comprising a hydraulic motor for moving said movable element, a control module comprising a transducer for producing an electric signal corresponding to the actual position of the movable element, means for producing an electrical signal corresponding to the desired pump displacement, means for comparing the electrical signal from the transducer and the electrical signal corresponding to the desired displacement and producing an error signal, and means operable in response to said error signal to meter fluid flow from the pump output to the hydraulic motor, said last mentioned means comprising an electrically operated valve, said control module including an electronic modulator for converting the error signal to a pulse train signal having a pulse width proportional to the magnitude of the error signal, said last mentioned means comprising an electro hydraulic three-way flow control valve, said control valve comprising a solenoid operated servo valve, said valve comprising a body having a pressure port connected to the pump output, a tank port connected to the reservoir, a service port connected to the hydraulic motor, a spool having a service port portion which serves to cut off fluid flow between the service port of the valve and the pressure port or the tank port depending on the position of the spool, said spool including a service land which controls the flow from pressure port to service port and from the service port to tank port, the width of the land being slightly less than the opening of the service port such that in the neutral position, restricted orifices are provided between the service port and the pressure and tank ports thereby venting the hydraulic motor to tank to insure the positioning of the movable element of the pump at its full stroke position, said spool being formed with an axial passage intersected by a radial passage that is at all times in communication with the tank port, said axial passage connecting opposed ends of the spool with the tank port through a restriction formed therein, said spool having a pair of radial orifices, each of which is in communication with each end of the spool at all times, but upon movement of the spool in either direction, fluid flow from one fluid chamber to the other is restricted by an orifice, and improving the response to energization of one or the other of the solenoids.

7. The variable displacement pump control system set forth in claim 6 including a pair of proportional solenoids between which the servo spool is positioned and spring members acting to center the servo spool in a neutral position in the absence of energization of either of the solenoids.

8. The variable displacement pump control system set forth in claim 6 including a pair of proportional solenoids between which the servo spool is positioned and spring members acting to center the servo spool in a neutral position in the absence of energization of either of the solenoids.

9. The variable displacement pump control system set forth in claim 6 including a compensator valve operable to dampen momentary excessive rates of pressure that may occur in the pump output.

10. The variable displacement pump control system set forth in claim 9 wherein said compensator valve comprises a three-way valve having a compensator valve body, a spool operable in said body and having a pilot chamber at one end and a spring chamber at the other end, a spring member in the spring chamber, said spring chamber serving as an accumulator volume, said spool of said compensator valve having a passage connecting the pilot chamber with the spring chamber and formed with a restriction, said pilot chamber being connected to the output of the pump for applying pump output pressure against the spool of the compensator valve, said spring chamber being connected to the input of the relief element.

11. The variable displacement pump control system set forth in claim 10 wherein said compensator valve includes first, second and third ports, the first port being connected to the hydraulic motor of the pump, the second port being connected to the service port of the servo valve, and the third port being connected to the output of the pump, such that when the spool of the compensator valve is in its normal position under the action of the spring member, the first and second ports are in communication with each other and communication is established between the servo valve service port and the hydraulic motor and when the spool of the compensator valve is shifted by pressure at maximum pressure setting, communication between the servo output port and the hydraulic motor in interrupted and communication between the pump output and the hydraulic pump is established.

12. The variable displacement pump control system set forth in claim 11 including a pressure relief valve operable upon a preselected system pressure.

13. A three-way servo valve comprising a body having a pressure port connected to the pump output, a tank port adapted to be connected to a reservoir a service port connected to the hydraulic motor, a spool having a service port portion which serves to cut off fluid flow between the service port of the valve and the pressure port or the tank port depending on the position of the spool, said spool including a service land which obstructs flow from either the pressure or tank ports to and from the service port when the spool is in neutral position, the width of the land being slightly less then the opening of the service port such that in the neutral position, a restricted orifice is provided between the service port and the pressure and tank to insure the positioning of the movable element of the pump at its full stroke position, said spool being formed with an axial passage intersected by a radial passage that is at all times in communication with the tank port, said axial passage connecting opposed ends of the spool with the tank port through a restriction formed therein, said spool having a pair of radial passages, each of which is in communication with each end of the spool in the neutral position of the spool, but upon movement of the spool in either direction, communication between one or the other of the ends of the spool is interrupted thereby dampening the movement of the spool to the restricted displacement of fluid from one end of the spool to the other and improving the response to energization of one or the other of the solenoids.

14. The variable displacement pump control system set forth in claim 13 including a pair of proportional solenoids between which the servo spool is positioned and spring members acting to center the servo spool in a neutral position in the absence of energization of either of the solenoids.

* * * * *